US012196510B1

(12) United States Patent
Bruno

(10) Patent No.: US 12,196,510 B1
(45) Date of Patent: Jan. 14, 2025

(54) FIREARM LOCKING MECHANISM

(71) Applicant: Ataraxia LLC, Hanover, MD (US)

(72) Inventor: Lydia Bruno, Hanover, MD (US)

(73) Assignee: Ataraxia LLC, Hanover, MD (US)

( * ) Notice: Subject to any disclaimer, the term of this patent is extended or adjusted under 35 U.S.C. 154(b) by 36 days.

(21) Appl. No.: 18/349,248

(22) Filed: Jul. 10, 2023

(51) Int. Cl.
*F41A 17/06* (2006.01)
*F41A 9/62* (2006.01)
*F41A 17/48* (2006.01)

(52) U.S. Cl.
CPC ..... *F41A 17/063* (2013.01); *F41A 9/62* (2013.01); *F41A 17/48* (2013.01)

(58) Field of Classification Search
CPC ..... F41A 17/063; F41A 17/066; F41A 17/46; F41A 17/08; F41A 17/38; F41A 9/65; F41A 17/06; F41A 17/34; F41A 17/36; F41A 9/62; F41A 17/48; F41A 35/06; F41A 21/48; F41A 11/02; F41C 23/16; F41C 23/14; F41B 11/62; F41B 11/73
USPC ..... 42/70.11, 70.01, 70.02, 6, 69.01
See application file for complete search history.

(56) References Cited

U.S. PATENT DOCUMENTS 8,046,948 B2 * 11/2011 Mauch ..... F41A 17/063 42/70.08
8,966,797 B2 * 3/2015 Carlson ..... F41A 19/25 42/70.11
9,841,249 B1 12/2017 Nicks et al.
9,857,133 B1 * 1/2018 Kloepfer ..... G06F 21/32
10,969,202 B2 * 4/2021 Teetzel ..... F41A 9/53
11,466,950 B2 * 10/2022 Nieh ..... F41A 17/08
11,692,783 B2 * 7/2023 Chandler ..... H02J 50/10 42/70.06
11,808,537 B2 * 11/2023 Teetzel ..... G06V 40/19
11,920,880 B2 * 3/2024 Chandler ..... F41A 17/46
11,933,558 B2 * 3/2024 Chandler ..... F41A 17/46
11,933,560 B2 * 3/2024 Chandler ..... F41A 17/066
2017/0146310 A1 5/2017 Biran
2019/0257609 A1 8/2019 Bascom
2020/0355450 A1 11/2020 Masarik et al.
2021/0231398 A1 7/2021 Dulude et al.
2022/0136790 A1 5/2022 Holland

FOREIGN PATENT DOCUMENTS

WO 2020077254 A1 4/2020

* cited by examiner

*Primary Examiner* — Michael D David
(74) *Attorney, Agent, or Firm* — Briggs Intellectual Property Law; Jeremy A. Briggs

(57) ABSTRACT

A magazine for a firearm is described. The magazine may include a magazine housing comprising a recess at a front wall of a magazine housing top portion facing a trigger bar of the firearm. The magazine may further include a locking unit configured to move between a locked position and an unlocked position. The magazine may further include a radio-frequency identification (RFID) reader disposed in the magazine housing. The RFID reader is configured to detect presence of a wearable device in proximity to the trigger bar. The magazine may further include a control unit configured to control locking unit movement based on inputs from the RFID reader. The control unit may be configured to move the locking unit from the locked position to the unlocked position when the RFID reader detects presence of the wearable device in proximity to the trigger bar.

20 Claims, 6 Drawing Sheets

FIREARM LOCKING MECHANISM

TECHNICAL FIELD

The present disclosure relates to a firearm, and more specifically to an automatic firearm locking mechanism that prevents unauthorized or unintentional firearm use.

BACKGROUND

Firearm owners typically uses locks to prevent firearm misuse such as unauthorized or unintentional discharge of ammunition. Conventional firearm locks include trigger locks, cable locks, gun safes, etc. that secure firearm usage.

The trigger locks are configured to prevent trigger manipulation. Specifically, the trigger locks prevent unintentional triggering of a trigger bar. However, conventional trigger locks may not secure firearm usage in certain scenarios. For example, the conventional trigger locks are not designed to be used on a loaded firearm. A firearm owner typically has to unlock the trigger lock, load the firearm and then use the firearm. Loading the firearm after unlocking the trigger lock may cause user inconvenience, as the firearm may not be ready to use immediately after unlocking the trigger lock and the user may have to wait to use the firearm till the firearm may be loaded. Further, the conventional trigger lock does not prevent trigger manipulation after the firearm is loaded, and may hence not be efficient in preventing unintentional firearm use after the firearm is loaded.

Thus, there exists a need for a secure and convenient locking mechanism that may be used on a loaded firearm and prevents firearm misuse.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
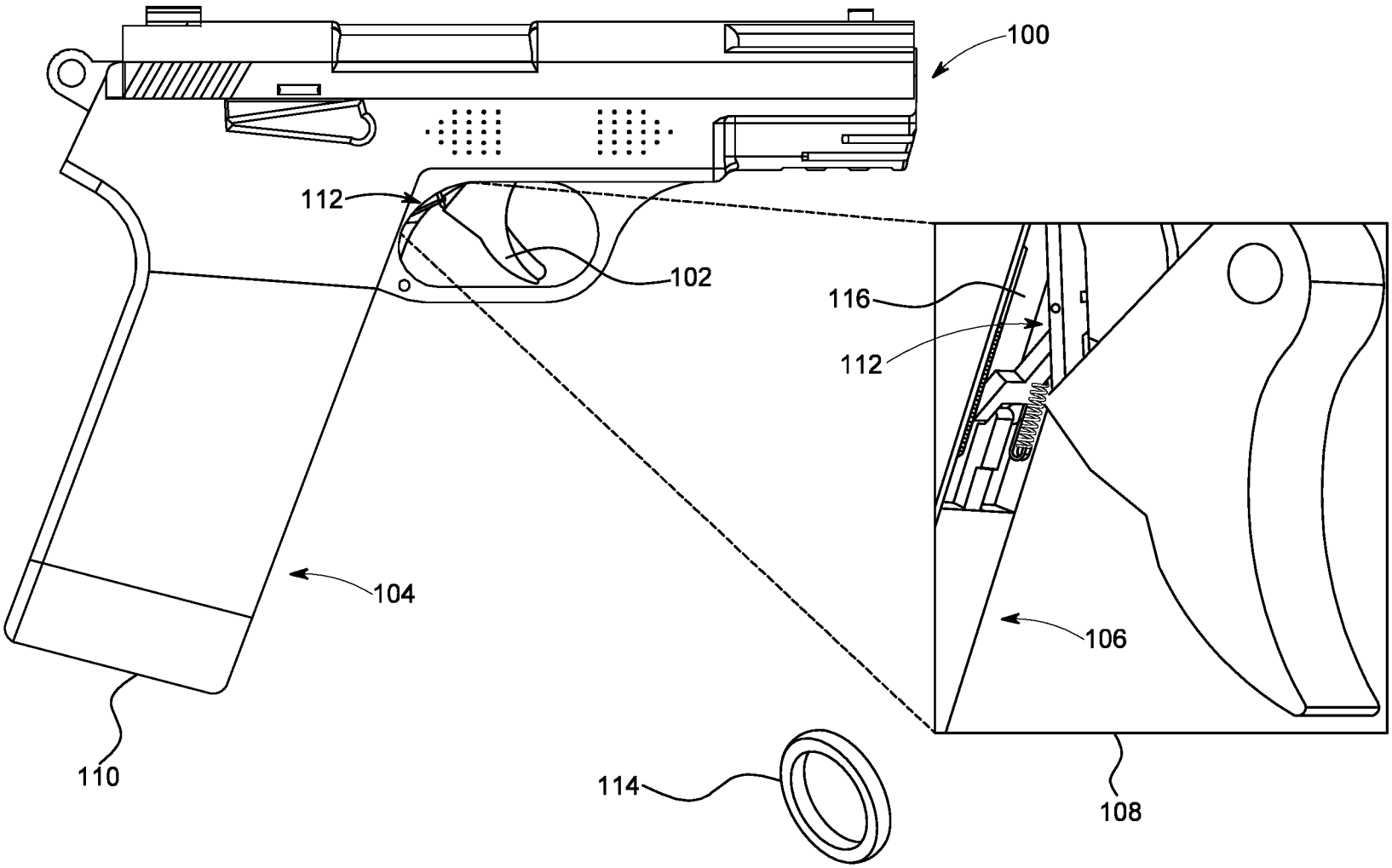
FIG. 1 depicts a perspective view of a firearm in a locked position in accordance with the present disclosure.

The present disclosure describes a firearm locking mechanism/system that may prevent firearm misuse. The firearm locking system may be disposed in a firearm magazine. The firearm locking system may be configured to lock (or block) and unlock (or unblock) trigger bar movement. Specifically, the firearm locking system may allow depressing of the trigger bar when the firearm locking system detects that a user wearing an authorized wearable device (e.g., a ring, a bracelet, a smartwatch, etc.) may be using the firearm. In some aspects, the firearm locking system may include a radio-frequency identification (RFID) reader that may be configured to detect the authorized wearable device. The wearable device may have a corresponding RFID transmitter. The RFID reader may detect the presence of authorized wearable device when the wearable device comes in proximity to the firearm.

In some aspects, the firearm locking system may include a locking unit that may be configured to physically block the trigger bar movement (i.e., depressing of the trigger bar). The locking unit may be configured to move between a locked state and an unlocked state based on the inputs from the RFID reader. The locking unit may be disposed in a recess located at a magazine housing top portion. Specifically, the recess may be disposed on a magazine housing front wall that faces the trigger bar. The locking unit may include a double arm arrangement (or a cam lever arrangement) having a first arm and a second arm that may be pivotally connected with each other at a joint (e.g., at a point at which the first arm may be connected to the second arm). The double arm arrangement may be configured to fold out from the recess and form a "V-shaped" arrangement in the locked position. The double arm arrangement may remain or be disposed inside the recess in the unlocked position.

The firearm locking system may further include a control unit that may be configured to control locking unit movement based on the inputs from the RFID reader. The control unit may include an electromagnet (or a solenoid actuator) and one or more linear actuators. When the RFID reader detects authorized wearable device presence, the electromagnet may be energized and may actuate the linear actuator. The linear actuator may be connected to the locking unit via one or more connecting rods, and may be configured to move the locking unit from the locked state to the unlocked state (and vice-versa).

In some aspects, the firearm may include a firearm management unit that may be configured to manage firearm operation. The firearm management unit may include a plurality of units including, but not limited to, a transmitter, a memory, a processor, a GPS receiver, and/or the like. The transmitter may be configured to transmit information associated with the firearm to a user device. In some aspects, the transmitter may transmit firearm location determined by the GPS receiver to the user device. In addition, the transmitter may transmit other information including, but not limited to, a count of ammunition items in the magazine, firearm usage history, firearm battery condition, and/or the like, to the user device.

The present disclosure discloses a firearm locking system that prevents unauthorized firearm usage. Specifically, the firearm locking system may enable the firearm to detect authorized user and unlock the firearm automatically. The authorized user may not have to spend effort in getting the firearm ready for operation (or to unlock the firearm manually), and may use the firearm conveniently by using the firearm locking system.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

Figure 2:
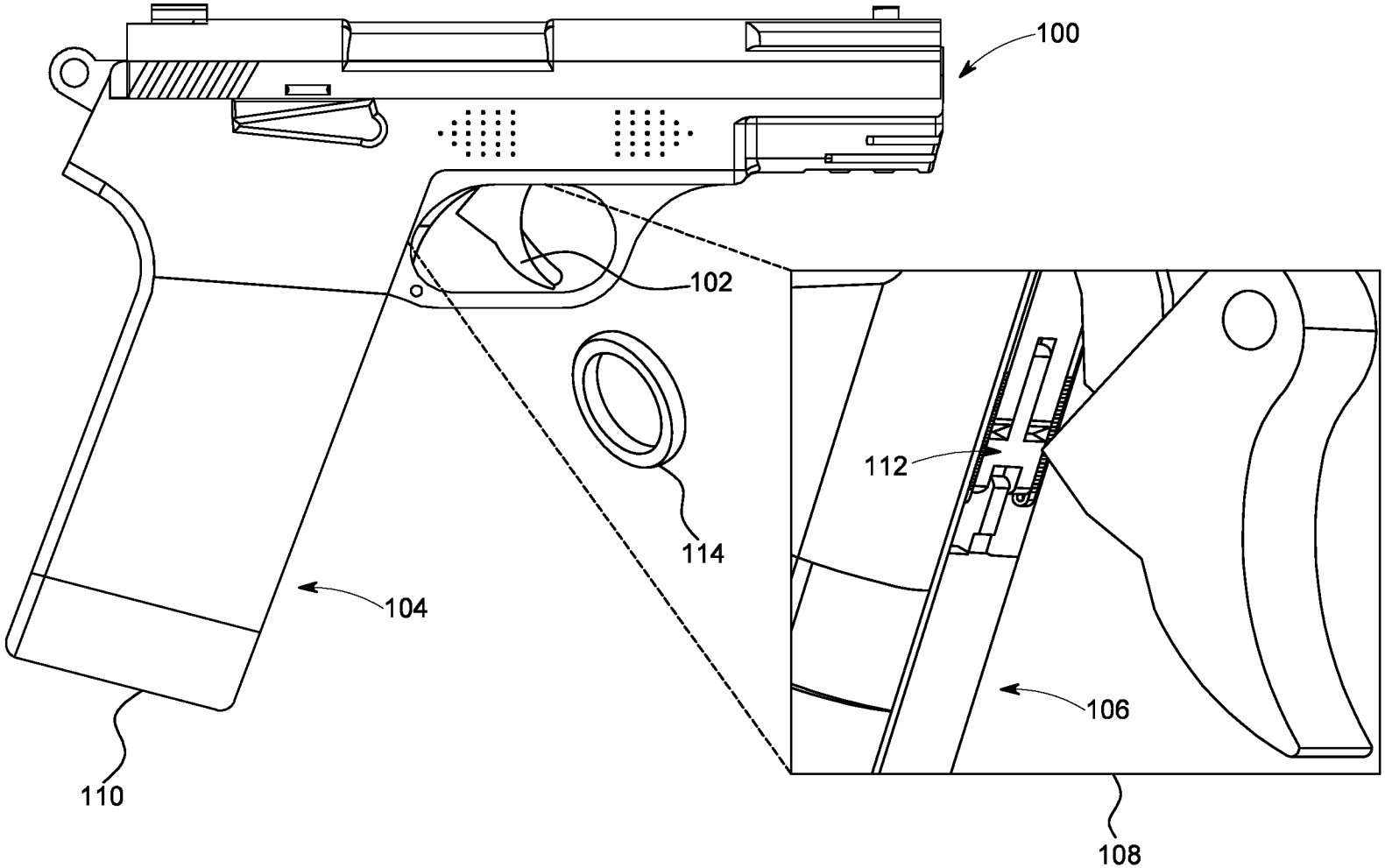
FIG. 2 depicts a perspective view of a firearm in an unlocked position in accordance with the present disclosure.
Figure 3:
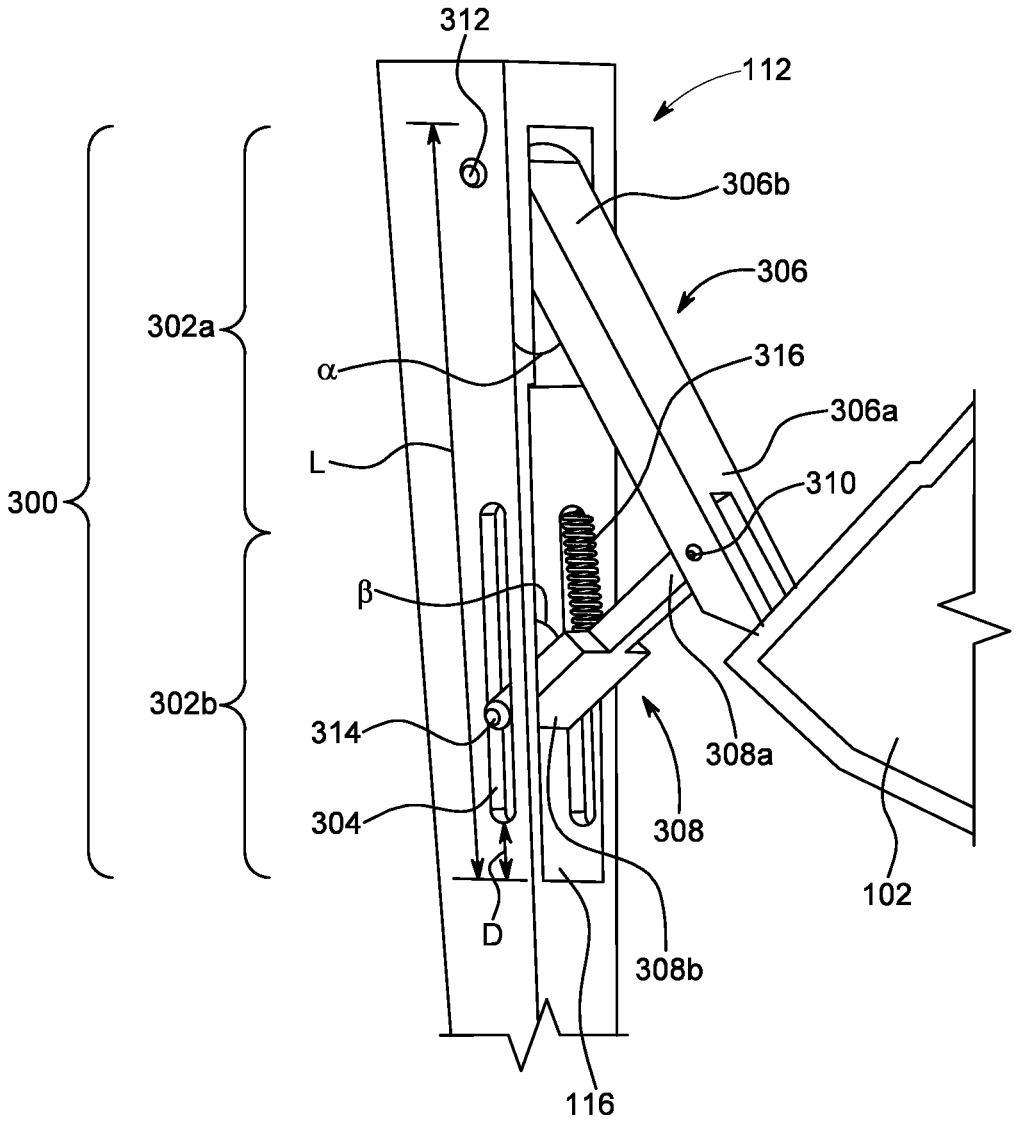
FIG. 3 depicts a view of a top portion of an example magazine of a firearm, in accordance with the present disclosure.
Figure 4:
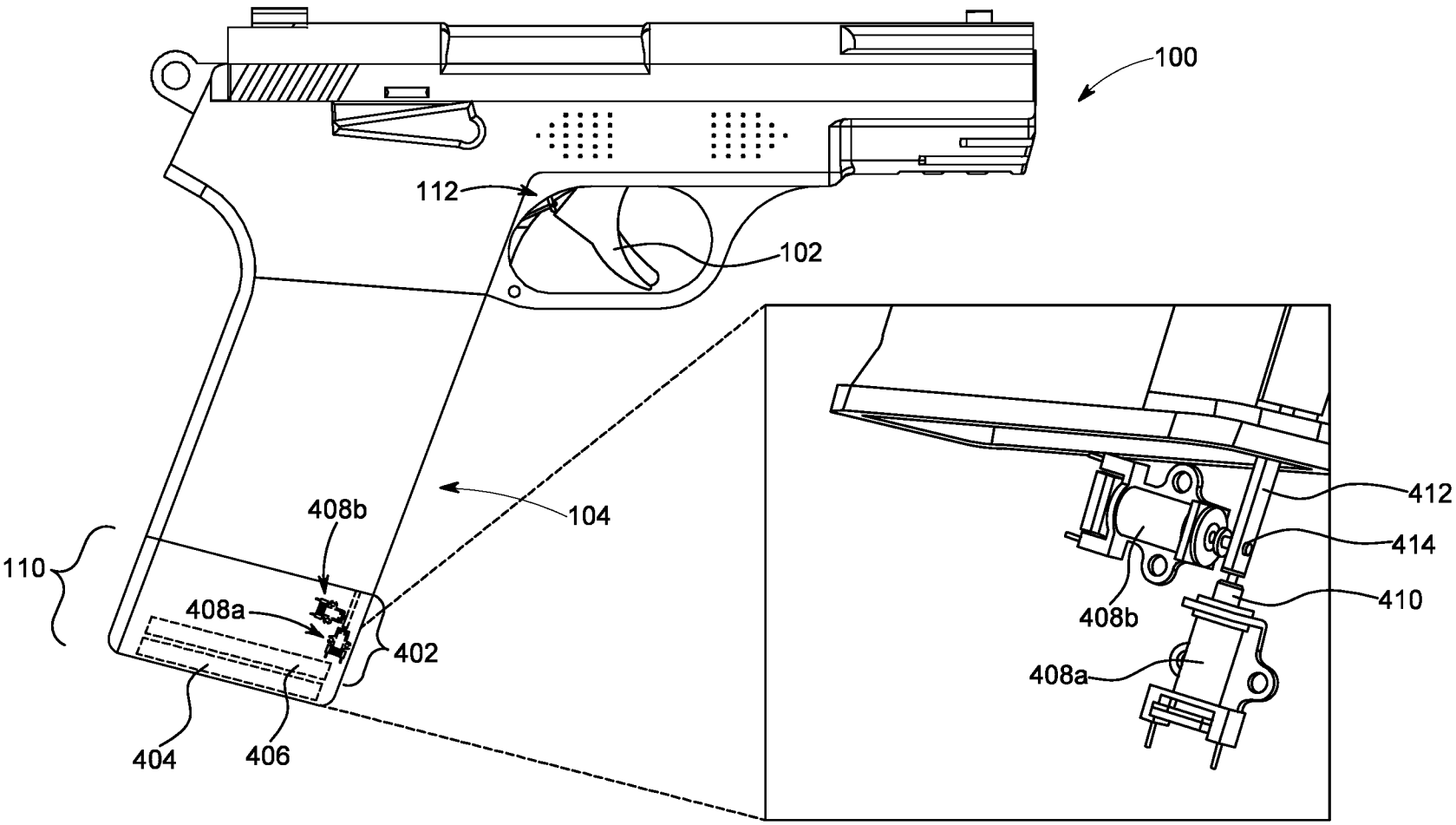
FIG. 4 depicts a perspective view of a control unit of a firearm in a locked position, in accordance with the present disclosure.
Figure 5:
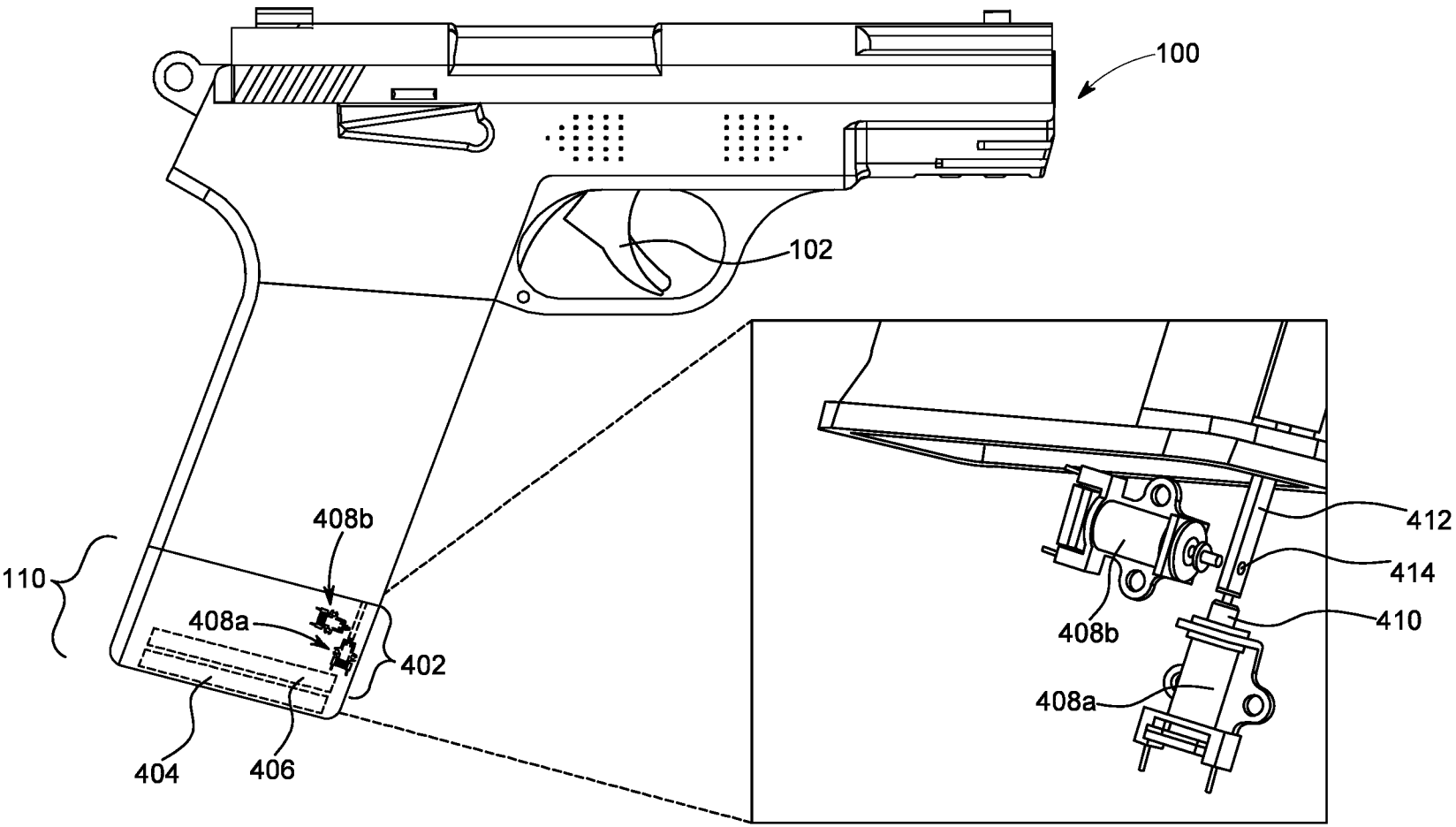
FIG. 5 depicts a perspective view of a control unit of a firearm in an unlocked position, in accordance with the present disclosure.

FIG. 1 depicts a perspective view of a firearm 100 in a locked position (or locked state) in accordance with the present disclosure. FIG. 1 will be described in conjunction with FIGS. 2-5. FIG. 2 depicts a perspective view of the firearm 100 in an unlocked position (or unlocked state). FIG. 3 depicts a view of a top portion of a magazine of the firearm 100. Further, FIGS. 4 and 5 depict perspective views of a control unit of the firearm 100 in locked and unlocked positions, respectively.

The firearm 100 may include a plurality of components including, but not limited to, a trigger bar 102 and a frame 104 (or a holder) configured to receive and hold a magazine 106. An isometric front view of portion of the magazine 106 is shown in view 108 in FIG. 1. The magazine 106 may be a container that may be configured to store ammunition items or bullets (e.g., unused bullets). The magazine 106 may be removably placed in or inserted into the frame 104. A firearm user may remove the magazine 106 (e.g., when the ammunition items may be used and the magazine 106 may be required to be replenished), load the magazine 106 with fresh ammunition items and may insert the loaded magazine 106 in the frame 104 to reload the firearm 100. In some aspects, the firearm 100 may include a magazine extension 110 that may be removably attached to or be an integrated part of a magazine housing bottom portion.

The magazine 106 may include a trigger lock (hereinafter referred as a locking unit 112) that may be configured to prevent unauthorized or unintentional use of the firearm 100. The locking unit 112 may prevent trigger bar manipulation (e.g., depressing of the trigger bar 102) when the locking unit 112 may be in a locked position. On the other hand, the locking unit 112 may "unlock" the trigger bar manipulation when an authorized user accesses the firearm 100, as described below.

The firearm 100 may include an authentication unit 404 (shown in FIG. 4) that may be configured to identify or detect that an authorized user may be accessing the firearm 100. In some aspects, the authentication unit 404 may be disposed in the magazine extension 110. In further aspects, the authentication unit 404 may include a radio-frequency identification (RFID) reader (or an RFID chip) configured to communicatively couple with a wearable device 114 that the authorized user may be wearing. Specifically, the RFID reader may be configured to detect wearable device presence in proximity to the trigger bar 102, thus enabling the authentication unit 404 to detect that the authorized user may be accessing the firearm 100.

As described above, the wearable device 114 may be associated with the authorized user. The wearable device 114 may be a ring (as depicted in FIG. 1), a bracelet, a band, a smartwatch, and/or the like, which may be worn by the authorized user. The wearable device 114 may include an RFID transmitter (or a corresponding RFID chip, not shown) that may be configured to interact with the RFID reader of the authentication unit 404.

In some aspects, the locking unit 112 may be disposed in the locked position (and hence prevent depressing of the trigger bar 102, as depicted in FIG. 1) when the wearable device 114 may be located away from the firearm 100 (e.g., not be in proximity to the firearm 100 or the trigger bar 102). On the other hand, the locking unit 112 may switch from the locked position to the unlocked position (thereby allowing depressing of the trigger bar 102, as depicted in FIG. 2) when the wearable device 114 may move closer to the firearm 100 or the trigger bar 102 (and the wearable device 114 may be positioned in proximity to the firearm 100 or the trigger bar 102). Stated another way, the locking unit 112 may be configured to move between the locked position in which the locking unit 112 may block trigger bar movement (e.g., when the wearable device 114 may be away from the firearm 100) and an unlocked position in which the locking unit 112 may allow the trigger bar movement (e.g., when the wearable device 114 may be disposed in proximity to the firearm 100). The structural details of the magazine 106 including the locking unit 112 are described below.

The magazine 106 may include a magazine housing configured to enclose one or more magazine components. The magazine housing may include a recess 116 at a magazine housing top portion 300, as shown in FIG. 3. In some aspects, the recess 116 may be disposed on a front wall of the magazine housing top portion 300 that faces the trigger bar 102. Stated another way, the recess 116 may face a trigger bar backside. Here, the trigger bar backside refers to the side of the trigger bar 102 that is opposite to the trigger bar side that receives the user finger (e.g., when the user manipulates the trigger bar 102 or uses the firearm 100). In an exemplary aspect, a length "L" (as shown in FIG. 3) of the recess 116 may be 5-20% of a magazine length. As depicted in FIG. 3, the recess 116 may include a recess top portion 302*a* and a recess bottom portion 302*b*. The recess bottom portion 302*b* may include two extrusions 304 (or slots) disposed along a longitudinal axis of the recess 116. In some aspects, the extrusions 304 may be disposed on recess side walls (or sidewalls of the magazine housing including the recess 116) and may have lengths equivalent to or less than recess bottom portion length, as depicted in FIG. 3. In the exemplary aspect depicted in FIG. 3, extrusions bottom ends may be disposed at a predefined distance "D" from a bottom end of the recess bottom portion 302*b*.

In some aspects, the locking unit 112 may be disposed in the recess 116, and one or more components of the locking unit 112 may move in and out of the recess 116 based on locking unit state (e.g., locked state or unlocked state), as described later in the description below. The locking unit 112 may include a first arm 306 and a second arm 308 that may be pivotally connected with each other via a first pin connector 310. In some aspects, a first arm length may be 40-70% of a recess length and a second arm length may be 30-60% of the recess length. In some aspects, the first arm length may be greater than the second arm length. In an exemplary aspect, the first arm 306 and the second arm 308 may form a cam lever arrangement that may fold in a "V-shaped" arrangement when the locking unit 112 may be in the locked state.

The first arm 306 may include a first proximal end 306*a* and a first distal end 306*b*, and the second arm 308 may include a second proximal end 308*a* and a second distal end 308*b*. The first proximal end 306*a* and the second proximal end 308*a* may be pivotally connected to each other via the first pin connector 310.

In some aspects, the first distal end 306*b* may be pivotally attached to the recess side walls in proximity to a recess top portion top end via a second pin connector 312. When the locking unit 112 may be in the locked state, the first arm 306 may move out of the recess 116 by pivotally moving about the second pin connector 312. Specifically, when the locking unit 112 may be in the locked state, the first proximal end 306*a* may move out of the recess 116 and the first distal end 306*b* may pivotally move about the second pin connector 312. FIGS. 1 and 3 depict the locking unit 112 in the locked state, where the first proximal end 306*a* is disposed out of the recess 116. In an exemplary aspect, a first arm longitudinal axis may form an angle "α" (e.g., a non-zero angle) relative to a recess or magazine longitudinal axis when the first proximal end 306*a* may be disposed out of the recess 116 (i.e., when the locking unit 112 may be in the locked state), as depicted in FIG. 3.

On the other hand, the first proximal end 306*a* may be disposed in the recess 116 when the locking unit 112 may be in the unlocked state, as depicted in FIGS. 2 and 4. In some aspects, the angle "α" may be equivalent to zero when the locking unit 112 may be in the unlocked state.

In further aspects, the second distal end 308*b* may attached to a third pin connector 314 disposed at the recess bottom portion 302*b*, specifically in the extrusions 304. In some aspects, the second distal end 308*b* may be configured to slidably move along an extrusion longitudinal axis via the third pin connector 314. Stated another way, the second distal end 308*b* may slide up and down (e.g., in upward position and downward position) along a recess or a magazine longitudinal axis via the extrusions 304 and the third pin connector 314.

In some aspects, when the second distal end 308*b* moves up along the extrusion longitudinal axis (e.g., in the upward position), the second proximal end 308*a* may move out of the recess 116 and the locking unit 112 may move in the locked state, as depicted in FIGS. 1 and 3. Stated another way, the locking unit 112 may be in the locked state when the second distal end 308*b* may be at the upward position or extrusion top end (and the second proximal end 308*a* is disposed out of the recess 116). When the second distal end 308*b* may move downwards (e.g., in the downward position), the second proximal end 308*a* may be disposed in the recess 116 and the locking unit 112 may move in the unlocked state. Stated another way, the locking unit 112 may be in the unlocked state when the second distal end 308*b* may be at the downward position or extrusion bottom end (and the second proximal end 308*a* is disposed in the recess 116). In an exemplary aspect, a second arm longitudinal axis may form an angle "β" (e.g., a non-zero angle) relative to the recess or magazine longitudinal axis when the second proximal end 308*a* may be disposed out of the recess 116 (i.e., when the locking unit 112 may be in the unlocked state), as depicted in FIG. 3. The angle "β" may be equivalent to zero (i.e., the second arm longitudinal axis may be parallel to the recess longitudinal axis) when the locking unit 112 may be in the unlocked state.

A person ordinarily skilled in the art may appreciate from the description above that when the locking unit 112 may be in the unlocked state, the first arm 306 and the second arm 308 may be disposed inside the recess 116 (e.g., the first arm longitudinal axis, the second arm longitudinal axis, and the recess longitudinal axis may be parallel, and "α" and "β" may be equivalent to zero). When the locking unit 112 may be in the locked state, the first proximal end 306*a* and the second proximal end 308*a* (that may be pivotally connected with each other, as described above) may move out of the recess 116 and block the trigger bar movement.

In some aspects, the locking unit 112 may further include a spring 316 having a first spring end and a second spring end. The first spring end may be attached to a recess side wall in proximity to an extrusion top end and the second spring end may be attached to the third pin connector 314. When the second distal end 308*b* moves up and down along the extrusion longitudinal axis to move the locking unit 112 between the locked state and the unlocked state, the spring 316 may generate a tension force to keep the locking unit 112 in the locked state (or vice-versa in the unlocked state).

The firearm 100 may further include a control unit 402 that may be disposed in the magazine extension 110 (as shown in FIG. 4) and may be configured to control locking unit movement. Specifically, the control unit 402 may move the locking unit 112 between the locked state and the unlocked state based on wearable device detection in proximity to the trigger bar 102.

As described above, the authentication unit 404 or an RFID reader (hereinafter referred to as the RFID reader 404) may be disposed in the magazine extension 110. The RFID reader 404 may be configured to detect wearable device presence in proximity to the trigger bar 102. In some aspects, the control unit 402 may be configured to move the locking unit 112 between the locked state and the unlocked state based on inputs obtained from the RFID reader 404. For example, the control unit 402 may move the locking unit 112 in the unlocked state when the RFID reader 404 detects the wearable device presence in proximity to the trigger bar 102.

In an exemplary aspect, the control unit 402 may include a plurality of units including, but not limited to, a solenoid actuator 406 (or an electromagnet) and one or more linear actuators such as a first linear actuator 408*a* and a second linear actuator 408*b*. In some aspects, the solenoid actuator 406 may be disposed in proximity to the RFID reader 404, as depicted in FIG. 4. The solenoid actuator 406 may be energized when the RFID reader 404 detects wearable device presence (e.g., due to generation of current) in proximity to the trigger bar 102 (and hence in proximity to the RFID reader 404). Responsive to being energized, the solenoid actuator 406 may actuate the first linear actuator 408*a* and/or the second linear actuator 408*b*. The linear actuators 408*a* and 408*b* may be configured to move the locking unit 112 between the locked position and the unlocked position, when the linear actuators 408*a* and 408*b* may be actuated by the solenoid actuator 406.

In some aspects, a longitudinal axis of the first linear actuator 408*a* may be disposed along a magazine longitudinal axis. Further, the first linear actuator 408*a* may be configured to move a stroke rod 410 associated with the first linear actuator 408*a* vertically up and down along the magazine longitudinal axis when the first linear actuator 408*a* may be actuated. The stroke rod 410 may be connected to the locking unit 112 via a connecting rod 412. In some aspects, the connecting rod 412 may be attached to the stroke rod 410 at one end and to the locking unit 112 at the other end. Stated another way, the connecting rod 412 may extend from the magazine extension 110 to the magazine housing top portion 300 (in which the locking unit 112 may be disposed, as described above in conjunction with FIG. 3).

In some aspects, the first linear actuator 408*a* may be configured to move the locking unit 112 in the locked position or the unlocked position by moving (e.g., pulling or pushing) the connecting rod 412 via the stroke rod 410. For example, the first linear actuator 408*a* may pull the connecting rod 412 downwards (e.g., to overcome force of the spring 316) to move the locking unit 112 from the locked position to the unlocked position, and may release or push the connecting rod 412 upwards to move the locking unit 112 from the unlocked position to the locked position. When the first linear actuator 408*a* releases the connecting rod 412, the spring 316 may be configured to move the locking unit 112 from the unlocked position to the locked position.

In further aspects, a longitudinal axis of the second linear actuator 408*b* may be disposed perpendicular to the longitudinal axis of the first linear actuator 408*a*. The second linear actuator 408*b* may be disposed above the first linear actuator 408*a* (e.g., between the first linear actuator 408*a* and the magazine bottom portion). In some aspects, the second linear actuator 408*b* may be configured to lock position or movement of the connecting rod 412 relative to the magazine bottom portion/first linear actuator 408*a*, and thus lock the locking unit movement. Specifically, the connecting rod 412 may include a slot 414 (or a through-hole) disposed in proximity to a connecting rod bottom end that may be connected to the stroke rod 410. The second linear actuator 408*b* may actuate or move horizontally along the longitudinal axis of the second linear actuator 408*b*, and insert a pin or an elongated protrusion (not shown) associated with the second linear actuator 408*b* into the slot 414 to lock the locking unit movement (e.g., in the lock the locking unit 112 in the locked state) and the connection rod movement. In some aspects, the second linear actuator 408*b* may be configured to lock the connecting rod movement when the pin may be aligned with the slot 414. In further aspects, the second linear actuator 408*b* may be configured to move away the pin from the slot 414 to enable the first linear actuator 408*a* to pull the connecting rod 412 downwards, and hence move the locking unit 112 to the unlocked state.

In operation, the locking unit 112 may be in the locked state when the firearm 100 may not be in use or not used by an authorized user (having the wearable device 114). In the locked state, the first arm 306 and the second arm 308 may extend out from the recess 116 (as described above) and block the trigger bar movement (e.g., may not allow depressing of the trigger bar 102). In addition, in the locked state, the pin associated with the second linear actuator 408*b* may be inserted in the slot 414 disposed at the connecting rod 412, to block connecting rod and hence locking unit movement.

When the wearable device 114 associated with the authorized user comes in proximity to the firearm 100 (or the trigger bar 102), the RFID reader 404 may detect wearable device presence. In some aspects, a low current may be generated by the RFID reader 404 (which may be amplified by using one or more amplifiers disposed in the magazine extension 110) when the RFID transmitter disposed in the wearable device 114 comes in proximity to the RFID reader 404. The generated current may actuate the solenoid actuator 406. Responsive to getting actuated, the solenoid actuator 406 may actuate the first linear actuator 408*a* and/or the second linear actuator 408*b* to move the locking unit 112 from the locked state to the unlocked state. Specifically, responsive to getting actuated, the second linear actuator 408*b* may move away from the connecting rod 412, and the pin associated with the second linear actuator 408*b* may be removed from the slot 414, as depicted in FIG. 5.

When the second linear actuator 408*b* may be moved away from the connecting rod 412, the first linear actuator 408*a* may pull the connecting rod 412 downwards along the magazine longitudinal axis (against the spring force). Pulling of the connecting rod 412 may slide the second arm 308 (e.g., the second distal end 308*b*) from the upward position to the downward position, e.g., towards the magazine extension. When the second distal end 308*b* slides downwards, the first arm 306 and the second arm 308 may move inside the recess 116, thus allowing the trigger bar 102 to be depressed by the authorized user. In this manner, the firearm 100 enables automatic firearm unlocking when the authorized user wearing the wearable device 114 uses the firearm 100.

In addition, when the wearable device 114 moves away from the firearm 100 (or the trigger bar 102), the locking unit 112 may move to the locked state due to the spring force. Specifically, the second distal end 308*b* may move upwards in the upward position (e.g., towards the recess top portion). When the second distal end 308*b* slides upwards, the connecting rod 412 may also move upwards. When the connecting rod 412 moves upwards, the slot 414 may also move upwards. When the slot 414 may be aligned with the pin associated with the second linear actuator 408*b*, the second linear actuator 408*b* may lock the connecting rod position, thereby moving the locking unit 112 in the locked position and locking connecting rod/locking unit movement.

Figure 6:
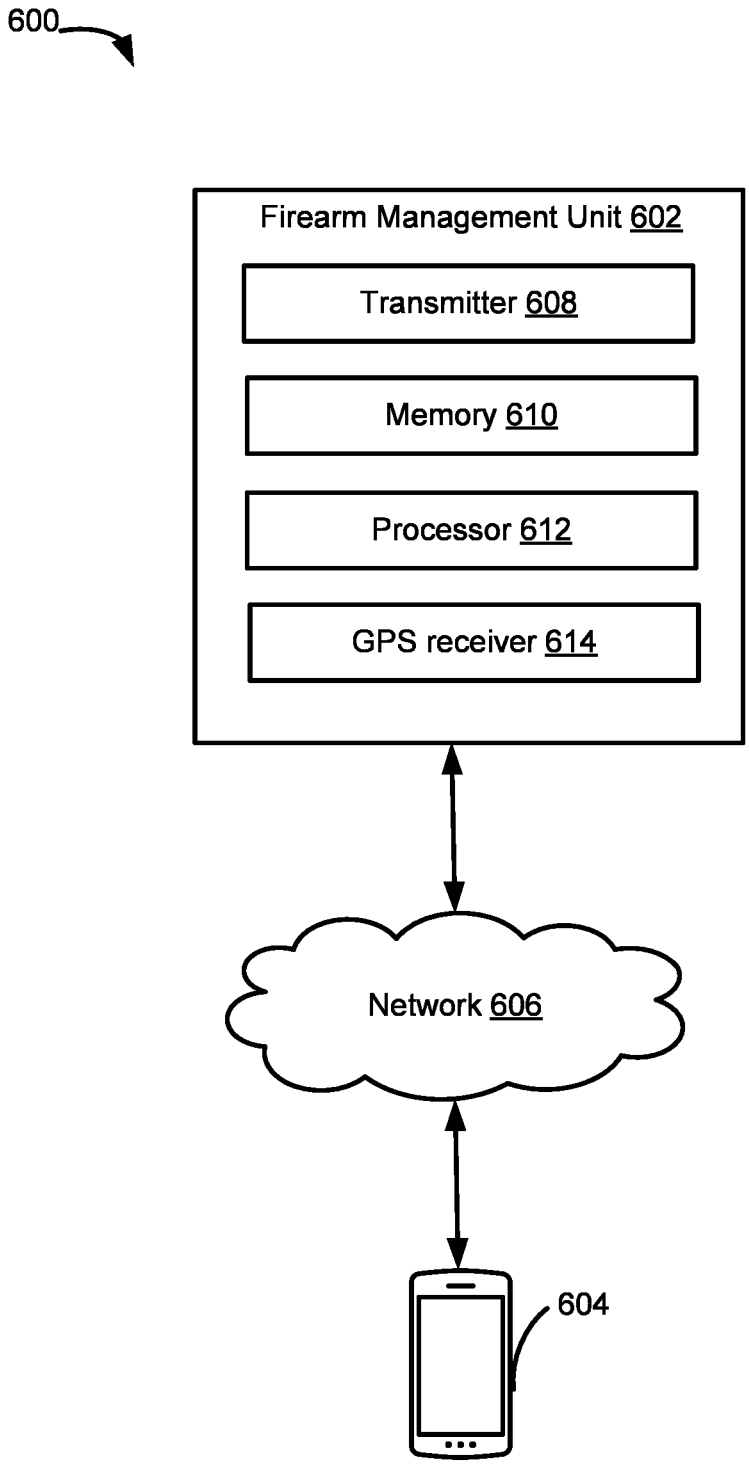
FIG. 6 depicts a block diagram of an example system 600 to manage a firearm in accordance with the present disclosure.

FIG. 6 depicts a block diagram of an example system 600 to manage the firearm 100 in accordance with the present disclosure. The system 600 may include a firearm management unit 602 that may be disposed inside the firearm 100 (e.g., in the frame 104, the magazine 106 or the magazine extension 110). The firearm management unit 602 may be communicatively connected with a user device 604 via one or more networks 606.

The network(s) 606 illustrates an example communication infrastructure in which the connected devices discussed in various embodiments of this disclosure may communicate. The network(s) 606 may be and/or include the Internet, a private network, public network or other configuration that operates using any one or more known communication protocols such as, for example, transmission control protocol/Internet protocol (TCP/IP), Bluetooth®, BLE®, Wi-Fi based on the Institute of Electrical and Electronics Engineers (IEEE) standard 802.11, UWB, and cellular technologies such as Time Division Multiple Access (TDMA), Code Division Multiple Access (CDMA), High-Speed Packet Access (HSPDA), Long-Term Evolution (LTE), Global System for Mobile Communications (GSM), and Fifth Generation (5G), to name a few examples. The user device 604 may include, but not limited to, a mobile phone, a laptop, a tablet, a smartwatch, other wearable device (such as the wearable device 114) or any such device having communication capability.

In some aspects, the firearm management unit 602 may a plurality of units including, but not limited to, a transmitter 608, a memory 610, a processor 612, and a GPS receiver 614, which may be communicatively coupled with each other. The GPS receiver 614 may be configured to determine a firearm geolocation. The transmitter 608 may be configured to transmit information associated with the firearm 100 to the external devices (such as the user device 604, the wearable device 114, and/or the like). The information associated with the firearm 100 may include, but is not limited to, a count of ammunition items in the magazine 106, firearm usage history, firearm battery condition, the firearm geolocation, and firing information (e.g., time stamps associated with each firing, firing angle, time between multiple firings, etc.), and/or the like. In some aspects, the information associated with the firearm 100 may be stored in the memory 610.

In some aspects, the processor 612 may obtain the information associated with the firearm 100 stored in the memory 610, and may cause the transmitter 608 to transmit the information to the external devices. In some aspects, the processor 612 may retrieve/obtain such information directly from firearm components. For example, the processor 612 may determine the firearm geolocation by using inputs obtained from the GPS receiver 614, and may transmit, via the transmitter 608 and the network 606, the firearm geolocation to the user device 604.

In some aspects, the processor 612 may control operation of the control unit 402 based on the firearm geolocation. Specifically, the control unit 402 may move the locking unit 112 between the locked state and the unlocked state based on the firearm geolocation. For example, the processor 612 may obtain the firearm geolocation from the GPS receiver 614 and determine that the firearm geolocation may be associated with a location where the firearm 100 may be authorized to operate. When the firearm geolocation is the authorized location, the processor 612 may enable the control unit 402 to move the locking unit 112 from the locked state to the unlocked state (when the wearable device 114 may be disposed in proximity to the trigger bar 102, as described above). On the other hand, when the firearm geolocation may not be in the authorized location, the processor 612 may not enable the control unit 402 to move the locking unit 112 from the locked state to the unlocked state. In further aspects, the processor 612 may determine activity (or firearm usage history) associated with the firearm 100 in the respective location and store such activity information in the memory 610, and may transmit such activity information to the user device 604.

In further aspects, the processor 612 may be configured to obtain information from a gyroscope (not shown) that may be installed in the firearm 100. Responsive to obtaining the information from the gyroscope, the processor 612 may determine if the user is holding the firearm 100 at a correct angle. The processor 612 may be further configured to transmit such information to the user device 604 and may provide recommendations for correct firearm position. The processor 612 may be configured to store information associated with such determination in the memory 610, and may be configured to keep track of firearm usage improvement associated with the user.

In further aspects, the processor 612 may be configured to obtain the information associated with the firearm 100, and may determine user performance (e.g., firing speed) associated with firearm usage. The processor 612 may correlate the user performance associated with a user profile (that may be stored in the memory 610), and may be configured to transmit the correlation to the user device 604. In further aspects, the processor 612 may be configured to provide scores to respective firearm users based on user performances, and transmit the score for each user profile to the user device 604.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems and methods described herein, it should be understood that, although some process steps may be described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, the application is capable of modification and variation.

All terms used in the claims are intended to be given their ordinary meanings as understood by those knowledgeable in the technologies described herein unless an explicit indication to the contrary is made herein. Use of the singular articles such as "α," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A magazine for a firearm comprising:

a magazine housing comprising a recess at a front wall of a magazine housing top portion facing a trigger bar of the firearm;

a locking unit configured to move between a locked position and an unlocked position, wherein the locking unit is configured to block trigger bar movement in the locked position, and wherein the locking unit is disposed in the recess;

a radio-frequency identification (RFID) reader disposed in the magazine housing, wherein the RFID reader is configured to communicatively couple with a wearable device, and wherein the RFID reader is configured to detect presence of the wearable device in proximity to the trigger bar; and a control unit configured to control locking unit movement based on inputs from the RFID reader, wherein the control unit is configured to move the locking unit from the locked position to the unlocked position when the RFID reader detects presence of the wearable device in proximity to the trigger bar.

2. The magazine of claim 1, wherein the recess comprises a recess top portion and a recess bottom portion, and wherein the recess bottom portion comprises extrusions on recess sidewalls.

3. The magazine of claim 2, wherein the locking unit comprises:

a first arm having a first proximal end and a first distal end; and a second arm having a second proximal end and a second distal end, and wherein the first proximal end is pivotally connected to the second proximal end.

4. The magazine of claim 3, wherein the first distal end is pivotally attached to a first pin disposed at the recess top portion.

5. The magazine of claim 3, wherein the second distal end is attached to a second pin disposed at recess bottom portion, wherein the second pin is disposed in the extrusions, and wherein the second distal end is configured to slidably move along a longitudinal axis of the extrusions.

6. The magazine of claim 5, wherein the locking unit is at the locked position when the second distal end is disposed at an extrusion top end, and wherein the locking unit is at the unlocked position when the second distal end is disposed at an extrusion bottom end.

7. The magazine of claim 6, wherein the locking unit comprises a spring connected between the extrusion top end and the second pin.

8. The magazine of claim 1 further comprising a magazine extension attached to a magazine housing bottom portion, wherein the control unit is disposed in the magazine extension.

9. The magazine of claim 8, wherein the RFID reader is disposed at the magazine extension.

10. The magazine of claim 1, wherein the control unit comprises a solenoid actuator and a linear actuator, and wherein the solenoid actuator is configured to configured to actuate the linear actuator when the RFID reader detects presence of the wearable device in proximity to the trigger bar.

11. The magazine of claim 10, wherein the linear actuator is configured to move the locking unit between the locked position and the unlocked position.

12. The magazine of claim 1 further comprising a firearm management unit, wherein the firearm management unit comprises:

a transmitter communicatively coupled to a user device, wherein the transmitter is configured to transmit information associated with the firearm to the user device; and a processor communicatively coupled with the transmitter, wherein the processor is configured to determine the information associated with the firearm.

13. The magazine of claim 12, wherein the information comprises at least one of: a count of ammunition items in the magazine, firearm usage history, battery condition, and a firearm geolocation.

14. The magazine of claim 1 further comprises a GPS receiver configured to determine a firearm geolocation, wherein the control unit is further configured to move the locking unit between the locked position and the unlocked position based on the firearm geolocation.

15. A magazine for a firearm comprising:

a magazine housing comprising a recess at a front wall of a magazine housing top portion facing a trigger bar of the firearm;

a locking unit configured to move between a locked position and an unlocked position, wherein the locking unit is configured to block trigger bar movement in the locked position, and wherein the locking unit is disposed in the recess;

a radio-frequency identification (RFID) reader disposed in the magazine housing, wherein the RFID reader is configured to communicatively couple with a wearable device, wherein the RFID reader is configured to detect presence of the wearable device in proximity to the trigger bar;

a control unit configured to control locking unit movement based on inputs from the RFID reader, wherein the control unit is configured to move the locking unit from the locked position to the unlocked position when the RFID reader detects presence of the wearable device in proximity to the trigger bar; and a magazine extension attached to a magazine housing bottom portion, wherein the control unit is disposed in the magazine extension.

16. The magazine of claim 15, wherein the RFID reader is disposed at the magazine extension.

17. The magazine of claim 15, wherein the recess comprises a recess top portion and a recess bottom portion, and wherein the recess bottom portion comprises extrusions on recess sidewalls.

18. The magazine of claim 15, wherein the locking unit comprises:

a first arm having a first proximal end and a first distal end; and a second arm having a second proximal end and a second distal end, and wherein the first proximal end is pivotally connected to the second proximal end.

19. The magazine of claim 3, wherein the first distal end is pivotally attached to a first pin disposed at the recess top portion, wherein the second distal end is attached to a second pin disposed at recess bottom portion, wherein the second pin is disposed in the extrusions, and wherein the second distal end is configured to slidably move along a longitudinal axis of the extrusions.

20. A magazine for a firearm comprising:

a magazine housing comprising a recess at a front wall of a magazine housing top portion facing a trigger bar of the firearm;

a locking unit configured to move between a locked position and an unlocked position, wherein the locking unit is configured to block trigger bar movement in the locked position, and wherein the locking unit is disposed in the recess;

a radio-frequency identification (RFID) reader disposed in the magazine housing, wherein the RFID reader is configured to communicatively couple with a wearable device, wherein the RFID reader is configured to detect presence of the wearable device in proximity to the trigger bar, and wherein the RFID reader is disposed at a magazine extension; and a control unit configured to control locking unit movement based on inputs from the RFID reader, wherein the control unit is configured to move the locking unit from the locked position to the unlocked position when the RFID reader detects presence of the wearable device in proximity to the trigger bar.

* * * * *